US008366508B2

(12) United States Patent
Filoseta et al.

(10) Patent No.: US 8,366,508 B2
(45) **Date of Patent: *Feb. 5, 2013**

(54) TOY VEHICLE BOOSTER AND TRACK SET

(75) Inventors: Miva Filoseta, Los Angeles, CA (US); Kin Fai Chang, Laguna (CN); Jebraeil Samo, Rowland Height, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/106,551

(22) Filed: May 12, 2011

(65) Prior Publication Data

US 2011/0212667 A1 Sep. 1, 2011

Related U.S. Application Data

(63) Continuation of application No. 11/691,379, filed on Mar. 26, 2007, now Pat. No. 7,955,158.

(51) Int. Cl.
*A63H 29/00* (2006.01)
*A63H 18/00* (2006.01)

(52) U.S. Cl. ..... 446/429; 446/444

(58) Field of Classification Search ..... 446/429, 446/430, 435, 444, 486
See application file for complete search history.

(56) References Cited

U.S. PATENT DOCUMENTS

| | | | | |
|---|---|---|---|---|
| 2,878,074 | A * | 3/1959 | Cawl | 301/64.707 |
| 3,590,524 | A * | 7/1971 | Beny et al. | 446/429 |
| 3,641,704 | A * | 2/1972 | Sims et al. | 446/429 |
| 4,174,587 | A * | 11/1979 | Morin et al. | 446/192 |
| 5,299,969 | A * | 4/1994 | Zaruba | 446/429 |
| 6,241,573 | B1 * | 6/2001 | Ostendorff et al. | 446/444 |
| 6,695,675 | B1 * | 2/2004 | Ngan | 446/429 |
| 6,793,554 | B1 * | 9/2004 | Newbold | 446/429 |
| 7,011,084 | B2 | 3/2006 | Richard | |
| 7,955,158 | B2 * | 6/2011 | Filoseta et al. | 446/429 |
| 2006/0169267 | A1 | 8/2006 | Nozato | |

* cited by examiner

*Primary Examiner* — Gene Kim
*Assistant Examiner* — Alyssa Hylinski
(74) *Attorney, Agent, or Firm* — Edell, Shapiro & Finnan LLC

(57) ABSTRACT

A booster for accelerating toy vehicles. The booster includes a rotation source and first and second wheels operatively coupled to the rotation source. Each wheel includes a thin-walled member configured to engage toy vehicles passing between the wheels as the rotation source rotates the wheels in opposite directions. The thin walled member is characterized by an S-shape that allows the relative distance between the wheels to change, thereby accommodating differently sized vehicles.

15 Claims, 3 Drawing Sheets

TOY VEHICLE BOOSTER AND TRACK SET

CROSS-REFERENCE TO RELATED APPLICATION

This application is a continuation of U.S. Non-Provisional patent application Ser. No. 11/691,379, filed Mar. 26, 2007 now U.S. Pat. No. 7,955,158, entitled "Toy Vehicle Booster and Track Set," the disclosure of which is incorporated by reference herein in its entirety.

BACKGROUND

Toy vehicle track sets may include one or more track sections arranged to form a closed loop around which one or more toy vehicles can travel. The toy vehicles used in such closed loops may be either self-powered or receive power from an external source. Devices used to accelerate unpowered toy vehicles around a track are often referred to as "boosters."

Boosters typically include one or more motor-driven rotating wheels adjacent to a portion of the track. As a vehicle passes through the portion of the track occupied by the booster, the rotating wheel temporarily engages the passing toy vehicle and accelerates the toy vehicle forward.

The most common type of booster includes a pair of spaced apart wheels on either side of the track. The pair of spaced apart wheels cooperate to simultaneously engage the passing toy vehicle from both sides.

Prior art booster wheels suffer from several problems. The most common type of booster wheel includes a disc-shaped member formed of a resilient foam material. Such a wheel may be prone to wear and may undesirably cup a passing vehicle from underneath, thus lifting the vehicle off the track. Furthermore, the foam may not be sufficiently deformable to accommodate wide toy vehicles.

A previous attempt to improve over a resilient foam booster wheel is described in U.S. Pat. No. 6,793,554. This patent describes a thin-walled booster wheel constructed from either plastic or rubber. The thin-walled booster wheel has improved wear resistance compared to foam booster wheels. However, under some operating conditions, the thin-walled booster wheel described in U.S. Pat. No. 6,793,554 may cup some toy vehicles from underneath, thus lifting such vehicles off the track.

SUMMARY

A booster for a toy vehicle track set is provided. The booster includes a booster wheel that is constructed from a thin-walled material. The thin-walled material is resiliently folded in an S-shaped configuration to impart energy to a wide range of differently shaped toy vehicles. The folded shape of the booster wheel also applies pressure evenly on toy vehicle surfaces, thus helping avoid lifting vehicles off the track.

WRITTEN DESCRIPTION

Figure 1:
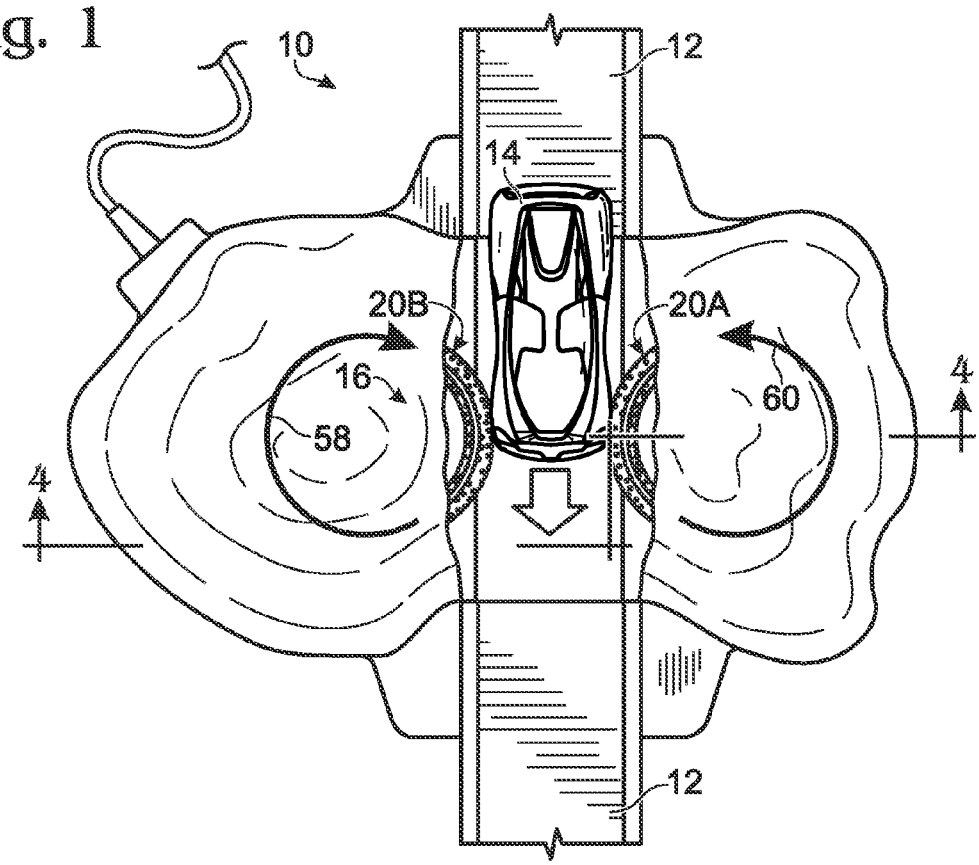
FIG. 1 is a plan view of a portion of a toy vehicle track set including a booster for accelerating toy vehicles.

FIG. 1 shows a portion of an exemplary toy vehicle track set 10. Track set 10 includes one or more track segments 12 on which a toy vehicle 14 can travel. Track set 10 also includes a booster 16 that accelerates toy vehicles over the track. For the sake of simplicity, FIG. 1 shows only the portion of the track in close proximity to booster 16. It should be understood that virtually any number of different track designs may be used without departing from the scope of this disclosure. Such designs include closed loop tracks and open tracks. Furthermore, while FIG. 1 shows only a single booster, it should be understood that two or more boosters can be used with the same track set. A booster according to the present disclosure may also be used to accelerate toy vehicles in play configurations that do not include a fixed track.

Figure 2:
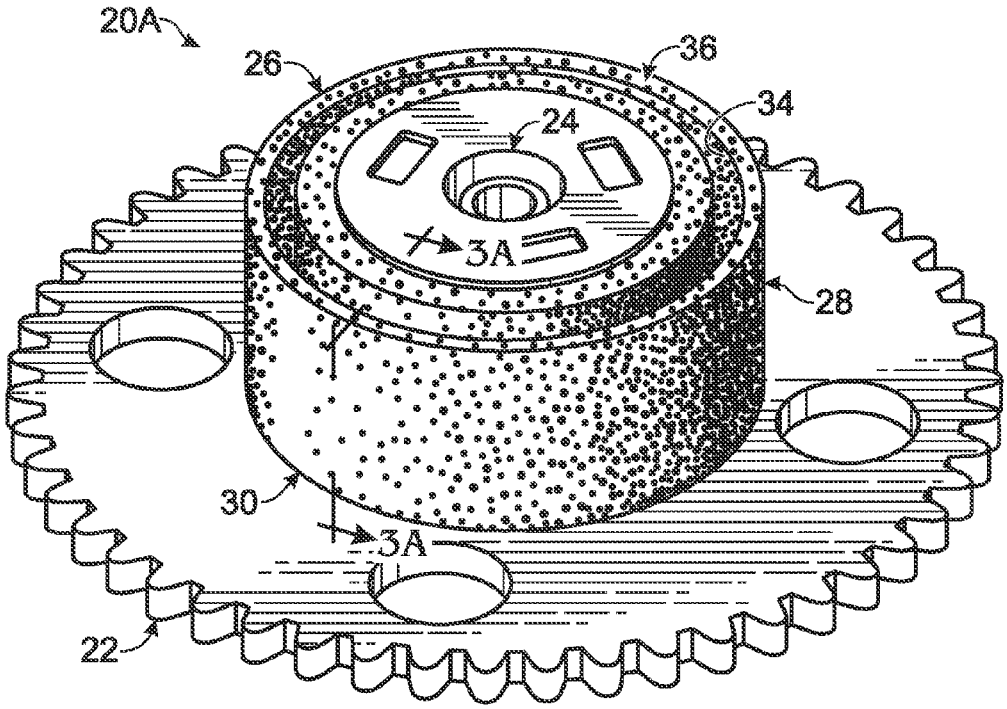
FIG. 2 shows a booster wheel assembly from the booster of FIG. 1.
Figure 3A:
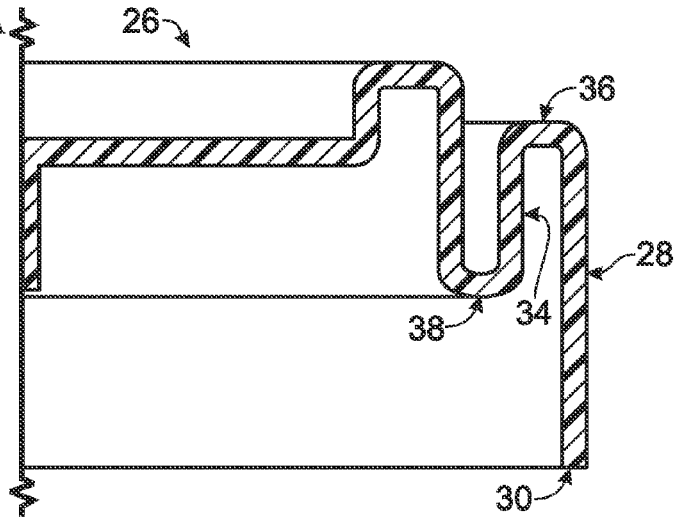
FIG. 3A shows a front cross-section of a thin-walled member of the booster wheel of FIG. 2 in a resting configuration.
Figure 3B:
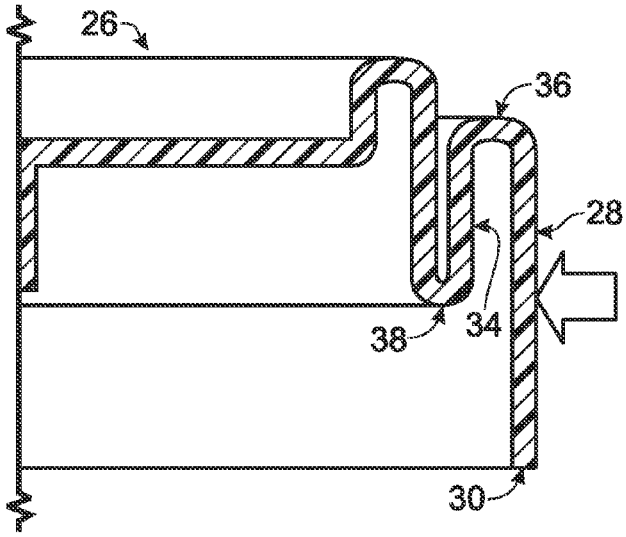
FIG. 3B shows a front cross-section of the thin-walled member of FIG. 3A in a compressed configuration.

Booster 16 includes a pair of booster wheels 20A and 20B. FIG. 2 shows booster wheel 20A in more detail. Although not required in all embodiments, booster wheel 20A includes a wheel gear 22 and a central support 24. The booster wheel also includes a thin-walled member 26 used to make contact with the toy vehicle and accelerate it forward. FIGS. 3A and 3B show a cross-section of a portion of thin-walled member 26.

Thin-walled member 26 can be shaped with a folded, or S-shaped, configuration. Furthermore, the thin-walled member can be constructed from a resilient material that can rebound from deformation. The combination of the folded configuration and the resilient material provides the wheel with a pliancy well suited for engaging a variety of differently sized and shaped toy vehicles with sufficient friction to accelerate a toy vehicle forward without lifting it off the track.

As shown in FIG. 3A, the thin-walled member includes an outer wall 28 at an outer diameter of the wheel. Outer wall 28 is the portion of the wheel that physically engages the toy vehicles. In the illustrated embodiment, the outer wall is shaped like a cylinder. In other embodiments, the outer wall can be shaped like a conical frustum or another suitable shape. In general, the outer wall is shaped to provide sufficient friction against a toy vehicle so that the outer wall can grip the toy vehicle and accelerate it forward. The outer wall is also shaped to avoid lifting toy vehicles from the track. As such, it does not include any lips or protrusions that could cup the underside of a toy vehicle.

The outer wall is at least partially defined by a terminal bottom edge 30 that is spaced away from an interior axle of the wheel. In other words, the outer wall is only supported from the top. The outer wall has greater horizontal compliance because it is only supported from the top.

The thin-walled member includes an intermediate wall 34 concentrically interior the outer wall. The intermediate wall can be shaped like a cylinder, a conical frustum, or another suitable shape. In the illustrated embodiment, the outer wall and the intermediate wall are substantially parallel, although this is not required in all embodiments. While the intermediate wall is illustrated as being shorter than the outer wall, it can be the same height or even taller without departing from the scope of this disclosure. The relative heights of the outer wall and the intermediate wall, and the spacing therebetween, can be selected to tune the relative horizontal compliance of the wheel. The thickness of the thin-walled member can also be selected to tune wheel pliancy.

The thin-walled member includes an outer linkage 36 connecting the outer wall to the intermediate wall. In the illustrated embodiment, the outer linkage has a substantially U-shaped cross section, although this is not required in all embodiments. As shown in FIG. 3B, the outer linkage can flex to allow a distance between the outer wall and the intermediate wall to decrease. In this manner, the outer wall can give way to toy vehicles having different widths and side profiles. The outer wall can remain substantially vertical when the outer linkage flexes, or the outer wall can slant inward or outward. Such flexibility allows the booster wheel to accommodate a variety of differently shaped toy vehicles.

Figure 4:
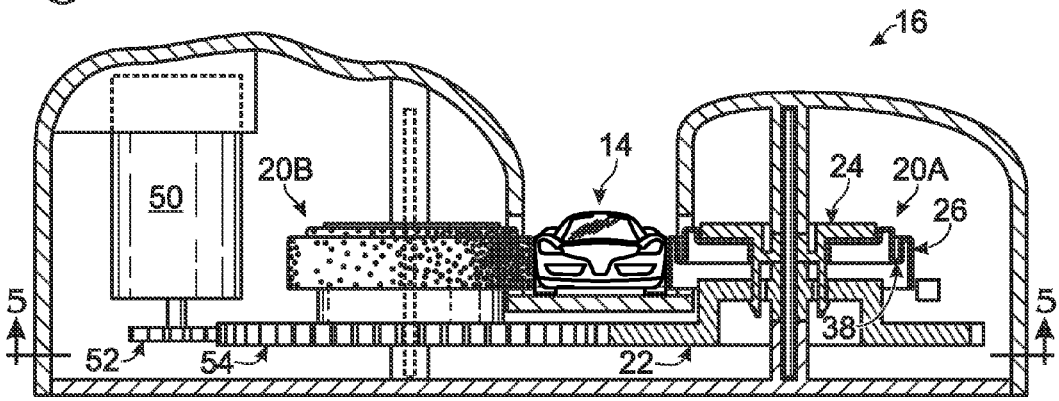
FIG. 4 is a front cross-section of the booster of FIG. 1.

The intermediate wall includes an inner linkage 38 that connects the intermediate wall to the interior of the wheel assembly. For example, as best shown in FIG. 4, the inner linkage is connected to central support 24, which is connected to wheel gear 22, which is operatively connected to a rotation source, such as an electric motor 50. It should be understood that the illustrated arrangement is provided only as an example. The inner linkage can be alternatively configured to accommodate different rotation sources and/or inner-wheel constructions.

In the illustrated embodiment, a portion of the inner linkage has a substantially U-shaped cross section. The inner linkage supports the intermediate wall in a spaced-apart relationship relative the interior of the wheel. As such, as shown in FIG. 3B, the inner linkage can flex to allow a distance between the intermediate wall and the interior of the wheel to decrease. The inner linkage cooperates with the intermediate wall and the outer linkage to support the outer wall in a compliant manner, essentially serving as a tuned spring that allows the outer wall to deform as necessary to accommodate variously shaped toy vehicles.

Figure 3C:
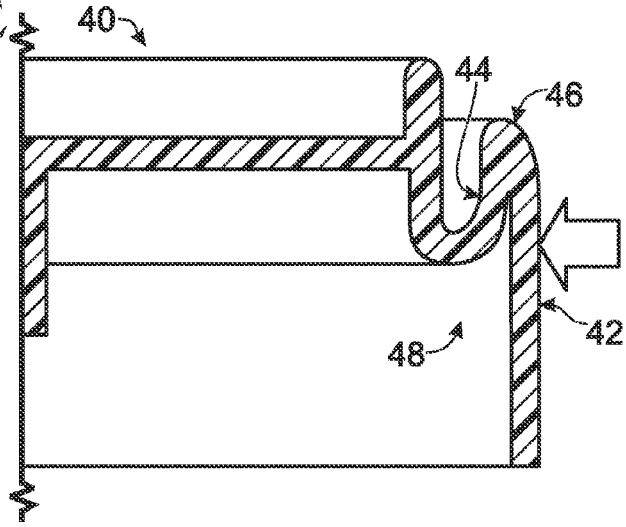
FIG. 3C shows a front cross-section of another thin-walled member in accordance with the present disclosure.

FIG. 3C shows a cross-section of a portion of another S-shaped, thin-walled member 40 in accordance with the present disclosure. Similar to thin-walled member 26, thin-walled member 40 includes an outer wall 42, an intermediate wall 44 concentrically interior the outer wall, a substantially U-shaped outer linkage 46 connecting the outer wall to the intermediate wall, and an inner linkage 48 that includes a substantially U-shaped cross-section. Outer linkage 46 is thickened in the illustrated embodiment, thus decreasing the relative angular flexibility at the outer linkage. As such, the inner linkage can serve as a pivot point about which the outer wall can pivot when engaging a toy vehicle.

Figure 5:
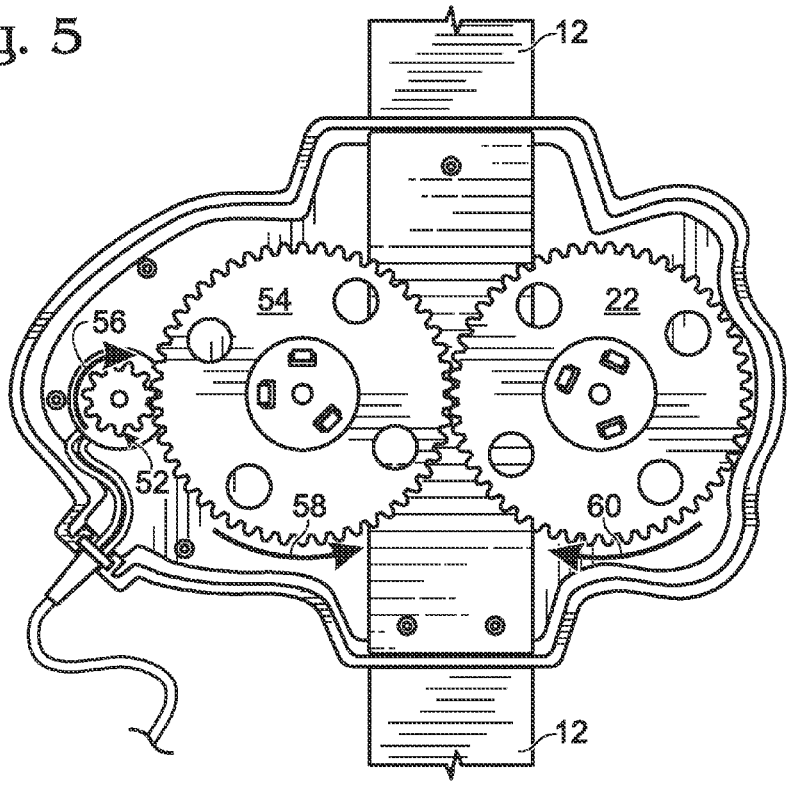
FIG. 5 is a bottom cross-section of the booster of FIG. 1.

FIGS. 4 and 5 show an exemplary mechanism that can be used to rotate booster wheels in accordance with the present disclosure. In particular, FIG. 4 shows a rotation source in the form of an electric motor 50 configured to receive power from an alternating current power cord. Alternative rotation sources can be battery-operated, wind-up operated, or powered via another suitable source. For purposes of this disclosure, portions of the booster wheel other than the thin-walled member can be referred to as part of the rotation source. For example, central support 24 can be referred to as part of the rotation source.

Electric motor 50 turns a drive gear 52, which is operatively coupled to a wheel gear 54 of booster wheel 20B. Wheel gear 54 is operatively coupled to a wheel gear 22 of booster wheel 20A. As best shown in FIG. 5, when drive gear 52 turns in the direction indicated by arrow 56, wheel gear 54 (and booster wheel 20B) turns in the direction indicated by arrow 58, while wheel gear 22 (and booster wheel 20A) turns in the direction indicated by arrow 60. The opposite direction rotations of booster wheels 20A and 20B provides the appropriate rotational direction for accelerating a toy vehicle entering the space therebetween. Furthermore, the gear ratio between wheel gear 22 and wheel gear 54 can be matched so that booster wheels 20A and 20B rotate at the same speed. The gear ratio between drive gear 52 and wheel gear 54 can be selected to provide the booster wheels with a desired rotation speed relative to the rotation speed of the rotation source.

While the present invention has been described in terms of specific embodiments, it should be appreciated that the spirit and scope of the invention is not limited to those embodiments. The scope of the invention is instead indicated by the appended claims. All subject matter which comes within the meaning and range of equivalency of the claims is to be embraced within the scope of the claims.

What is claimed is:

1. A toy vehicle track set, comprising:

a track; and a booster proximate to the track for accelerating a toy vehicle along the track, the booster including:

a first wheel having a folded configuration and including an outer wall, a central support, a thin-walled member coupled to the central support, and an intermediate wall, the intermediate wall being connected to the outer wall by an outer linkage having a substantially U-shaped cross section and being connected to the central support by an inner linkage having a substantially U-shaped cross-section, the first wheel being formed of a resilient material, the folded configuration of the first wheel allowing for movement of the outer wall of the first wheel;

a second wheel having a folded configuration and an outer wall, the second wheel being formed of a resilient material, the folded configuration of the second wheel allowing for movement of the outer wall of the second wheel; and a drive mechanism connected to the first wheel and to the second wheel, the drive mechanism being operable to rotate the first wheel and the second wheel in opposite directions, the outer wall of the first wheel and the outer wall of the second wheel being engageable with a toy vehicle when the first wheel and the second wheel are rotated by the drive mechanism.

2. The toy vehicle track set of claim 1, wherein the outer wall of the first wheel has a substantially cylindrical shape.

3. The toy vehicle track set of claim 1, wherein the outer wall of the first wheel and the intermediate wall of the first wheel are substantially parallel to each other.

4. The toy vehicle track set of claim 1, wherein the outer wall of the first wheel has a height, the intermediate wall of the first wheel has a height, and the height of the outer wall of the first wheel is greater than the height of the intermediate wall of the first wheel.

5. The toy vehicle track set of claim 1, wherein the outer wall of the first wheel has a terminal bottom edge that is spaced apart from a center of the first wheel.

6. The toy vehicle track set of claim 1, wherein the outer linkage is flexible and allows a distance between the outer wall of the first wheel and the intermediate wall of the first wheel to vary.

7. The toy vehicle track set of claim 1, wherein the inner linkage is flexible and allows a distance between the intermediate wall and the central support of the first wheel to vary.

8. The toy vehicle track set of claim 1, wherein a cross-section of the outer wall of the first wheel, the intermediate wall of the first wheel, the outer linkage of the first wheel, and the inner linkage of the first wheel collectively has a substantially S-shaped configuration.

9. A toy vehicle track set, comprising:

a track; and a booster proximate to the track for accelerating a toy vehicle along the track, the booster including:

a booster wheel mounted for rotation, the booster wheel including a thin-walled member having a folded configuration and an interior, the thin-walled member including a first wall and a second wall, the second wall of the booster wheel being coupled to the first wall of the booster wheel by an outer connector and being coupled to the interior of the booster wheel by an inner connector, the outer connector allowing movement of the first wall of the booster wheel relative to the second wall of the booster wheel, the inner connector allowing movement of the second wall of the booster wheel relative to the interior of the booster wheel; and a motor connected to the booster wheel, the motor being operable to rotate the booster wheel, the first wall of the booster wheel being engageable with the toy vehicle when the booster wheel is rotated by the motor.

10. The toy vehicle track set of claim 9, wherein the first wall of the booster wheel is substantially parallel to the second wall of the booster wheel.

11. The toy vehicle track set of claim 9, wherein the first wall of the booster wheel is substantially cylindrical and the second wall of the booster wheel is substantially cylindrical.

12. The toy vehicle track set of claim 9, wherein the outer connector flexes to allow a distance between the first wall of the booster wheel and the second wall of the booster wheel to decrease.

13. The toy vehicle track set of claim 9, wherein the inner connector flexes to allow a distance between the second wall of the booster wheel and the interior of the booster wheel to decrease.

14. The toy vehicle track set of claim 9, wherein at least one of the outer connector or the inner connector has the folded configuration.

15. A toy vehicle track set, comprising:

a track; and a booster proximate to the track for accelerating a toy vehicle along the track, the booster including:

a drive mechanism; and a booster wheel including a central support and a thin-walled member coupled to the central support, the booster wheel being mounted for rotation about the central support, the booster wheel being coupled to the drive mechanism so that the drive mechanism imparts rotation to the booster wheel during operation, the thin-walled member of the booster wheel having a folded configuration, the thin-walled member including an inner wall, an outer wall that has a surface that can engage the toy vehicle, a first connector coupling the outer wall to the inner wall, and a second connector coupling the inner wall to the central support, a cross-section of the outer wall, the inner wall, the first connector, and the second connector collectively has a substantially S-shaped configuration, the folded configuration of the thin-walled member allowing for movement of the outer wall relative to the central support so that the surface of the outer wall of the booster wheel can be used to engage toy vehicles with different configurations.

* * * * *